US008731803B2

(12) United States Patent
Wang et al.

(10) Patent No.: US 8,731,803 B2
(45) Date of Patent: May 20, 2014

(54) SYSTEM AND METHOD TO ESTIMATE INTAKE CHARGE TEMPERATURE FOR INTERNAL COMBUSTION ENGINES

(75) Inventors: Yue-Yun Wang, Troy, MI (US); Ibrahim Haskara, Macomb, MI (US); Ping Ge, Northville Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 361 days.

(21) Appl. No.: 13/186,602

(22) Filed: Jul. 20, 2011

(65) Prior Publication Data

US 2013/0024085 A1 Jan. 24, 2013

(51) Int. Cl.
*F02B 47/10* (2006.01)
*F02B 47/08* (2006.01)

(52) U.S. Cl.
USPC ..... 701/108; 123/568.15

(58) Field of Classification Search
USPC ..... 701/101, 102, 108; 123/568.15, 568.11; 73/114.31, 114.34, 114.74
See application file for complete search history.

(56) References Cited

U.S. PATENT DOCUMENTS

| | | | | |
|---|---|---|---|---|
| 6,286,366 | B1 * | 9/2001 | Chen et al. | 73/114.31 |
| 6,738,707 | B2 * | 5/2004 | Kotwicki et al. | 701/108 |
| 2005/0096833 | A1 * | 5/2005 | Nakazawa | 701/102 |
| 2012/0290193 | A1 * | 11/2012 | Suzuki et al. | 701/103 |

OTHER PUBLICATIONS

U.S. Appl. No. 12/848,188, Not Publ'd, Wang et al.
U.S. Appl. No. 12/982,994, Not Publ'd, Wang et al.

* cited by examiner

*Primary Examiner* — Mahmoud Gimie

(57) ABSTRACT

An engine includes an intake manifold mixing an intake air flow and an exhaust gas recirculation flow to provide an intake charge flow. A method to estimate an intake charge temperature of the intake charge includes monitoring system conditions for the engine, determining an effect of the mixing upon a specific heat coefficient of the intake charge flow based upon the monitored system conditions, estimating the intake charge temperature based upon the effect of the mixing upon the specific heat coefficient of the intake charge flow and the monitored system conditions, and controlling the engine based upon the estimated intake charge temperature.

14 Claims, 5 Drawing Sheets

SYSTEM AND METHOD TO ESTIMATE INTAKE CHARGE TEMPERATURE FOR INTERNAL COMBUSTION ENGINES

TECHNICAL FIELD

This disclosure is related to control of an internal combustion engine.

BACKGROUND

The statements in this section merely provide background information related to the present disclosure. Accordingly, such statements are not intended to constitute an admission of prior art.

An engine can include a charging system, including a turbocharger or supercharger device to provide charged intake air to the engine, improving performance of the engine. The charging device compresses the intake air or fresh air flow, and in the process of compressing the air, the temperature of the intake air is also increased. The increased temperature of the intake air exiting the charging device includes a lower density than air at ambient temperatures. A charge air cooler device is a heat exchanger used to cool the pressurized intake air, increasing the density of the intake air.

An exhaust gas recirculation (EGR) circuit is used to provide an EGR flow, depleted of oxygen, to an intake manifold, wherein the intake air flow and the EGR flow are mixed to create an intake charge flow for combustion in the cylinders of the engine. The EGR circuit can include an EGR cooler, a heat exchanger used to reduce the temperature of the EGR flow.

Operation of the engine depends upon the properties of the intake charge flow. Controlling temperature of the intake air flow, the EGR flow, and the intake charge flow is important to effective and efficient control of the engine. Temperature of a gas flow can be measured by temperature sensors known in the art.

SUMMARY

An engine includes an intake manifold mixing an intake air flow and an exhaust gas recirculation flow to provide an intake charge flow. A method to estimate an intake charge temperature of the intake charge includes monitoring system conditions for the engine, determining an effect of the mixing upon a specific heat coefficient of the intake charge flow based upon the monitored system conditions, estimating the intake charge temperature based upon the effect of the mixing upon the specific heat coefficient of the intake charge flow and the monitored system conditions, and controlling the engine based upon the estimated intake charge temperature.

BRIEF DESCRIPTION OF THE DRAWINGS

One or more embodiments will now be described, by way of example, with reference to the accompanying drawings, in which.

DETAILED DESCRIPTION

Figure 1:
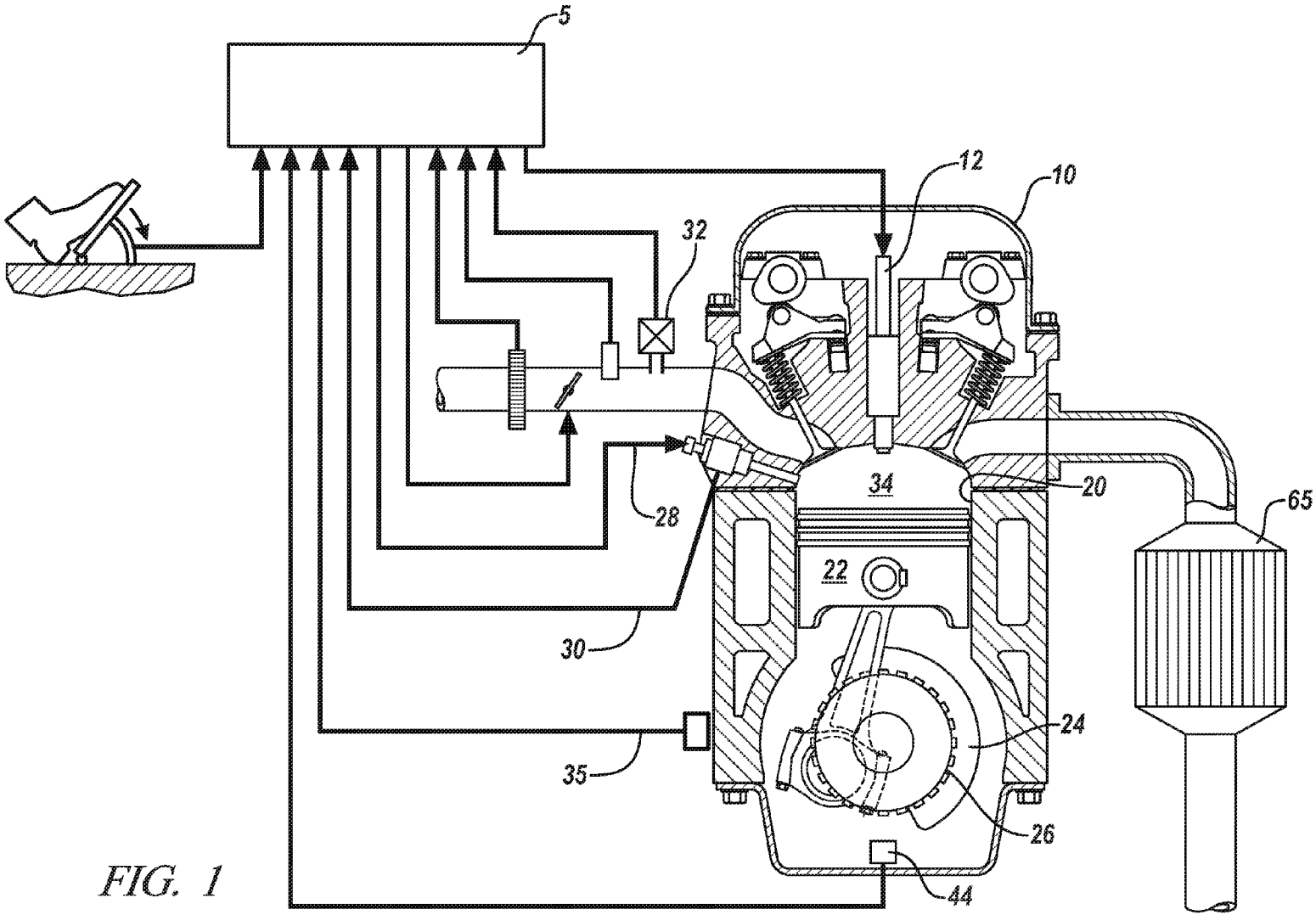
FIG. 1 illustrates an exemplary internal combustion engine, control module, and exhaust aftertreatment system, in accordance with the present disclosure.

Referring now to the drawings, wherein the showings are for the purpose of illustrating certain exemplary embodiments only and not for the purpose of limiting the same, FIG. 1 illustrates an exemplary internal combustion engine 10, control module 5, and exhaust aftertreatment system 65. The exemplary engine includes a multi-cylinder, direct-injection, compression-ignition internal combustion engine having reciprocating pistons 22 attached to a crankshaft 24 and movable in cylinders 20 which define variable volume combustion chambers 34. The crankshaft 24 is operably attached to a vehicle transmission and driveline to deliver tractive torque thereto, in response to an operator torque request, $T_{O_REQ}$. The engine preferably employs a four-stroke operation wherein each engine combustion cycle includes 720 degrees of angular rotation of crankshaft 24 divided into four 180-degree stages (intake-compression-expansion-exhaust), which are descriptive of reciprocating movement of the piston 22 in the engine cylinder 20. A multi-tooth target wheel 26 is attached to the crankshaft and rotates therewith. The engine includes sensors to monitor engine operation, and actuators which control engine operation. The sensors and actuators are signally or operatively connected to control module 5.

The engine is preferably a direct-injection, four-stroke, internal combustion engine including a variable volume combustion chamber defined by the piston reciprocating within the cylinder between top-dead-center and bottom-dead-center points and a cylinder head including an intake valve and an exhaust valve. The piston reciprocates in repetitive cycles each cycle including intake, compression, expansion, and exhaust strokes.

The engine preferably has an air/fuel operating regime that is primarily lean of stoichiometry. One having ordinary skill in the art understands that aspects of the disclosure are applicable to other engine configurations that operate primarily lean of stoichiometry, e.g., lean-burn spark-ignition engines. During normal operation of the compression-ignition engine, a combustion event occurs during each engine cycle when a fuel charge is injected into the combustion chamber to form, with the intake air or intake charge flow, the cylinder charge. The charge is subsequently combusted by action of compression thereof during the compression stroke.

The engine is adapted to operate over a broad range of temperatures, cylinder charge (fuel and intake charge flow, including air and sometimes EGR) and injection events. The methods described herein are particularly suited to operation with direct-injection compression-ignition engines operating lean of stoichiometry to determine conditions which correlate to heat release in each of the combustion chambers during ongoing operation. The methods are further applicable to other engine configurations, including spark-ignition engines, including those adapted to use homogeneous charge compression ignition (HCCI) strategies. The methods are applicable to systems utilizing multi-pulse fuel injection events per cylinder per engine cycle, e.g., a system employing a pilot injection for fuel reforming, a main injection event for engine power, and, where applicable, a post-combustion fuel injection event for aftertreatment management, each which affects cylinder pressure.

Sensors are installed on or near the engine to monitor physical characteristics and generate signals which are correlatable to engine and ambient conditions. The sensors include a crankshaft rotation sensor, including a crank sensor 44 for monitoring crankshaft (i.e. engine) speed (RPM) through sensing edges on the teeth of the multi-tooth target wheel 26. The crank sensor is known, and may include, e.g., a Hall-effect sensor, an inductive sensor, or a magnetoresistive sensor. Signal output from the crank sensor 44 is input to the control module 5. A combustion pressure sensor 30 is adapted to monitor in-cylinder pressure (COMB_PR). The combustion pressure sensor 30 is preferably non-intrusive and includes a force transducer having an annular cross-section that is adapted to be installed into the cylinder head at an opening for a glow-plug 28. The combustion pressure sensor 30 is installed in conjunction with the glow-plug 28, with combustion pressure mechanically transmitted through the glow-plug to the pressure sensor 30. The output signal, COMB_PR, of the pressure sensor 30 is proportional to cylinder pressure. The pressure sensor 30 includes a piezoceramic or other device adaptable as such. Other sensors preferably include a manifold pressure sensor for monitoring manifold pressure (MAP) and ambient barometric pressure (BARO), a mass air flow sensor for monitoring intake mass air flow (MAF), and a coolant sensor 35 monitoring engine coolant temperature (COOLANT). Sensors can additionally monitor intake air temperature ($T_{in}$), EGR temperature entering the intake manifold ($T_{erg}$), and temperature of the intake charge flow within the intake manifold ($T_c$) flowing to the cylinders. The system may include an exhaust gas sensor for monitoring states of one or more exhaust gas conditions, e.g., temperature, air/fuel ratio, and constituents. One skilled in the art understands that there may other sensors and methods for purposes of control and diagnostics. The operator input, in the form of the operator torque request, To_REQ, is typically obtained through a throttle pedal and a brake pedal, among other devices. The engine is preferably equipped with other sensors for monitoring operation and for purposes of system control. Each of the sensors is signally connected to the control module 5 to provide signal information which is transformed by the control module to information representative of the respective monitored condition. It is understood that this configuration is illustrative, not restrictive, including the various sensors being replaceable with functionally equivalent devices.

The actuators are installed on the engine and controlled by the control module 5 in response to operator inputs to achieve various performance goals. Actuators include an electronically-controlled throttle valve which controls throttle opening in response to a control signal (ETC), and a plurality of fuel injectors 12 for directly injecting fuel into each of the combustion chambers in response to a control signal (INJ_PW), all of which are controlled in response to the operator torque request, To_REQ. An EGR valve 32 and cooler control flow of externally recirculated EGR gas to the engine intake, in response to an EGR control signal from the control module. A glow-plug 28 is installed in each of the combustion chambers and adapted for use with the combustion pressure sensor 30. Additionally, a charging system can be employed in some embodiments supplying boost air according to a desired manifold air pressure.

Fuel injector 12 is a high-pressure fuel injector adapted to directly inject a fuel charge into one of the combustion chambers in response to the command signal, INJ_PW, from the control module. Each of the fuel injectors 12 is supplied pressurized fuel from a fuel distribution system, and have operating characteristics including a minimum pulsewidth and an associated minimum controllable fuel flow rate, and a maximum fuel flow rate.

The engine may be equipped with a controllable valvetrain operative to adjust openings and closings of intake and exhaust valves of each of the cylinders, including any one or more of valve timing, phasing (i.e., timing relative to crank angle and piston position), and magnitude of lift of valve openings. One exemplary system includes variable cam phasing, which is applicable to compression-ignition engines, spark-ignition engines, and homogeneous-charge compression ignition engines.

The control module 5 executes routines stored therein to control the aforementioned actuators to control engine operation, including throttle position, fuel injection mass and timing, EGR valve position to control flow of EGR flow, glow-plug operation, and control of intake and/or exhaust valve timing, phasing, and lift on systems so equipped. The control module is configured to receive input signals from the operator (e.g., a throttle pedal position and a brake pedal position) to determine To_REQ and from the sensors indicating the engine speed (RPM), $T_{in}$, coolant temperature, and other ambient conditions.

FIG. 1 depicts an exemplary diesel engine, however, methods described herein can similarly be utilized on other engine configurations including, for example, gasoline-fueled engines, ethanol or E85 fueled engines, or other similar known designs. The disclosure is not intended to be limited to the particular exemplary embodiments described herein.

Figure 2:
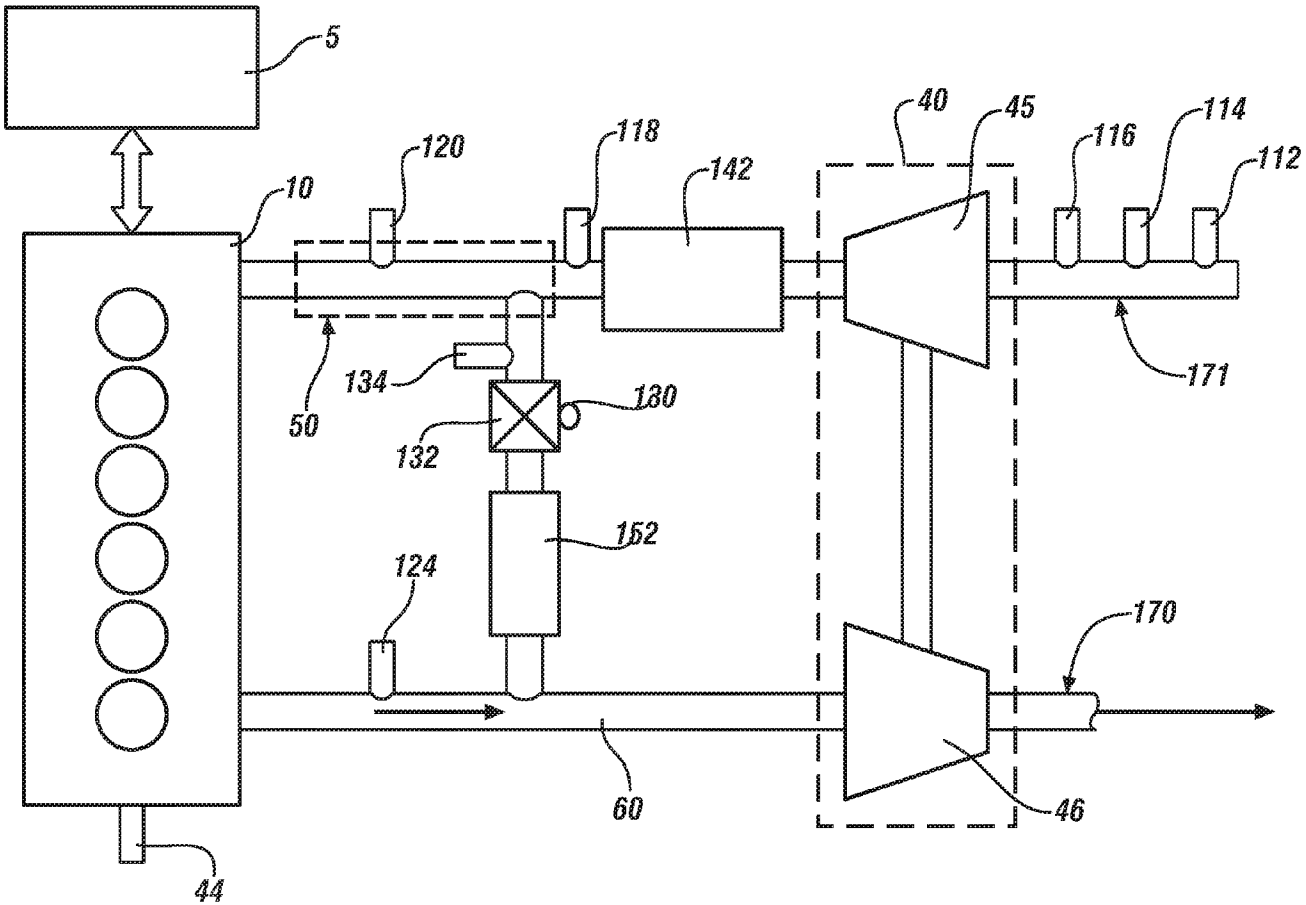
FIG. 2 illustrates an exemplary engine configuration including a turbocharger, in accordance with the present disclosure.

FIG. 2 illustrates an exemplary engine configuration including a turbocharger. The exemplary engine is multi-cylinder and includes a variety of fueling types and combustion strategies known in the art. Engine system components include an intake air compressor 40 including a turbine 46 and an air compressor 45, a charge air cooler 142, an EGR valve 132 and cooler 152, an intake manifold 50, and exhaust manifold 60. Ambient intake air is drawn into compressor 45 through intake 171. Pressurized intake air and EGR flow are delivered to intake manifold 50 for use in engine 10. Exhaust gas flow exits engine 10 through exhaust manifold 60, drives turbine 46, and exits through exhaust tube 170. The depicted EGR circuit is a high pressure EGR system, delivering pressurized exhaust gas from exhaust manifold 60 to intake manifold 50. An alternative configuration, a low pressure EGR system, can deliver low pressure exhaust gas from exhaust tube 170 to intake 171. Sensors are installed on the engine to monitor physical characteristics and generate signals which are correlatable to engine and ambient conditions. The sensors preferably include an ambient air pressure sensor 112, an ambient or intake air temperature sensor 114 monitoring $T_{in}$, and a mass air flow sensor 116 (all which can be configured individually or as a single integrated device, a MAP sensor 120, an exhaust gas temperature sensor 124 and an EGR valve position sensor 130. Engine speed sensor 44 monitors rotational speed of the engine. Additionally, intake air flow temperature sensor 118 is located to provide a temperature of the intake air flow ($T_{cac}$) after the intake air exits the charge air cooler 142 and before the intake air enters intake manifold 50, and EGR temperature sensor 134 is located to provide $T_{egr}$, monitored after EGR flow exits the EGR cooler 152 and before the EGR flow enters intake manifold 50. Each of the sensors is signally connected to the control module 5 to provide signal information which is transformed by the control module 5 to information representative of the respective monitored condition. It is understood that this configuration is illustrative, not restrictive, including the various sensors being replaceable within functionally equivalent devices and still fall within the scope of the disclosure. Furthermore, the intake air compressor 40 may include alternative turbocharger or supercharger configurations known in the art within the scope of this disclosure.

Accurate measurement of $T_c$ can improve engine power, fuel efficiency, and emissions. Performance variation or malfunction of either the charge air cooler or the EGR cooler can cause unexpected changes in $T_c$. A monitored or determined value of $T_c$ can be used to control engine operation to compensate for any variation between a desired $T_c$ and an actual $T_c$. $T_c$ can be monitored directly by a sensor, but sensors are expensive and create additional installation and maintenance issues.

Each of the flows entering and exiting the intake manifold, the intake air flow, the EGR flow, and the intake charge flow, includes different thermal properties. In particular, each flow includes distinct specific heat properties. Methods to estimate $T_c$ include inaccuracies based upon the mixing intake air flow and EGR flow in the manifold and the effects of the mixed gases thermal properties. One method to estimate an effect or correct for the effects of the thermal properties includes determining an effect of the mixing within the intake manifold upon the thermal properties, in particular, the specific heat, of the resulting intake charge flow flowing from the intake manifold to the cylinders of the engine (measured according to a specific heat coefficient, $c_{pc}$). Because the intake charge flow includes the mixture of the intake air flow and the EGR flow, a determination of the effect that the mixture has upon the specific heat of the intake air flow is one way to correct for the effects of the mixing gases. $c_{pc}$ can be determined directly, but can be computationally difficult to determine. One method to determine an effect of $c_{pc}$ upon the intake charge flow includes determining a ratio of the specific heat of the intake air flow entering the intake manifold (measured according to a specific heat coefficient, $c_{pa}$) to $c_{pc}$. By utilizing a ratio of $c_{pa}$ to $c_{pc}$ instead of an absolute value of $c_{pc}$ to estimate $T_c$, a degree to which the thermal properties of the intake air flow are changed in the mixing process can be evaluated instead of a more difficult determination of the absolute value of the thermal properties. A method is disclosed to estimate a temperature of an intake charge flow within an intake manifold of an engine including a correction for thermal properties of gases within the intake manifold and utilize the estimated temperature to control the engine. In one embodiment, the method includes monitoring system conditions for the engine, determining an effect of the mixing upon a specific heat coefficient of the intake charge flow based upon the monitored system conditions, determining the estimated intake charge temperature based upon the effect of the mixing upon a specific heat coefficient of the intake charge flow and the monitored system conditions, and controlling the engine based upon the estimated intake charge temperature.

According to one method to analyze an intake manifold, the manifold can be modeled as a container with a fixed volume including two inputs, one for the intake air flow ($W_a$) and one for the EGR flow ($W_{egr}$), and one output, the intake charge flow or the total charge flow exiting the manifold into the cylinders ($W_c$). $W_c$ can be described according to relationships known in the art according to the following relationship.

$$W_c = \eta_v \frac{D}{120} \frac{P}{R \cdot T_c} \cdot N \quad [1]$$

$\eta_v$ is a volumetric efficiency for the engine. D is a cylinder displacement volume. P is the intake manifold pressure, for example, measured by MAP sensor 120. N is the engine speed. R is the universal gas constant. Intake manifold dynamics can be modeled based upon an enthalpy equation according to the following relationship.

$$W_c c_{pc} T_c = W_a c_{pa} T_{cac} + W_{egr} c_{pe} T_{egr} - \frac{c_{vc} V}{R} \cdot \frac{dP}{dt} - \dot{Q} \quad [2]$$

$c_{pe}$ is a specific heat coefficients for the EGR flow.

$$\frac{c_{vc} V}{R} \cdot \frac{dP}{dt} - \dot{Q}$$

includes a measurement of losses within the intake manifold, wherein $c_{vc}$ is the specific heat coefficient for the contents of the intake manifold, V is the volume of the intake manifold, and $\dot{Q}$ is heat loss from intake manifold. dP/dt is a derivative of intake manifold pressure, for example, a manifold absolute pressure sensor reading, with respect to time. Assuming a mass balance expressed by the following relationship $$W_c = W_e + W_a \quad [3]$$

an estimate for $T_c$ can be made according to the following relationship $$T_c = \frac{c_{pa}}{c_{pc}} \left( f_A \cdot T_{cac} + (1 - f_A) \cdot \frac{c_{pe}}{c_{pa}} T_{egr} - \frac{V}{W_c \gamma R} \cdot \frac{dP}{dt} \right) \quad [4]$$

wherein $f_A$ is an air fraction denoted by the following.

$$f_A = \frac{W_a}{W_c} \quad [5]$$

$\gamma$ is a specific heat ratio known in the art.

Figure 3:
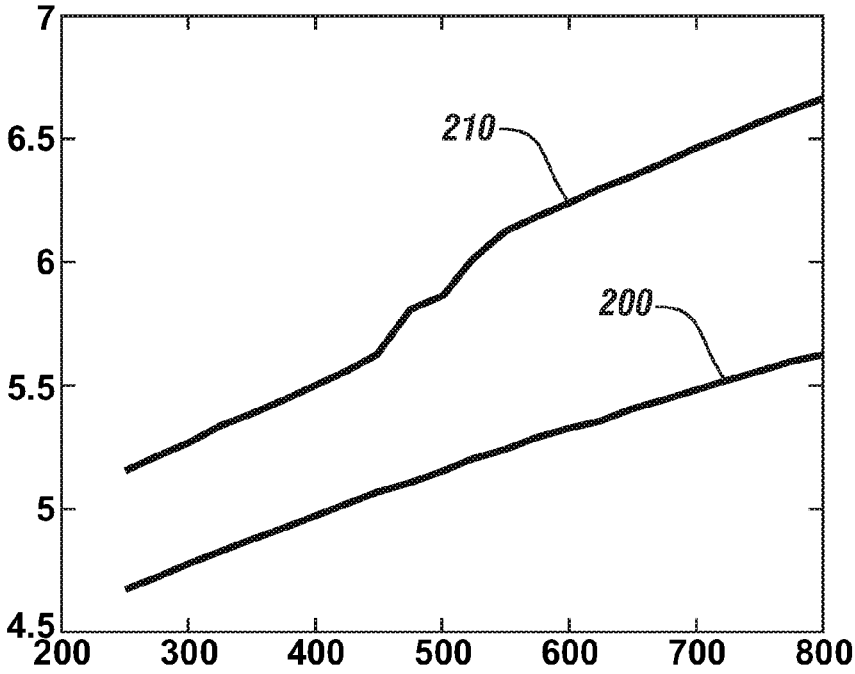
FIG. 3 illustrates exemplary specific heat values for an air flow and a stoichiometric fuel air mixture at constant volume through a range of temperatures, in accordance with the present disclosure.

Specific heat coefficients, in particular $c_{pc}$, impact an accuracy of the $T_c$ estimate. $c_{pc}$ is affected by a number of factors, including EGR mixing in the intake manifold and intake throttle position. Specific heats coefficients $c_{pa}$ and $c_{pe}$ can be denoted as follows:

$$c_{pa} = f(T_{cac}) \quad [6]$$

$$c_{pe} = R + \Phi \cdot f_{cvstoic}(T_{egr}) + (1 - \Phi) f_{cvair}(T_{egr}) \quad [7]$$

wherein $\Phi$ is an equivalence ratio for the charge. $f_{cvstoic}(T_{egr})$ and $f_{cvair}(T_{egr})$ are functions describing the behavior of specific heat coefficients under constant volume for air and a stoichiometric charge. FIG. 3 illustrates exemplary specific heat values for an air flow and a stoichiometric fuel air mixture at constant volume through a range of temperatures. The horizontal x-axis illustrates temperature in degrees K. The vertical y-axis illustrates specific heat. Plot 210 represents the specific heat for a particular stoichiometric charge, and plot 200 represents the specific heat for air. Such plots can be determined according to methods known in the art for a particular fuel type.

According to one embodiment, for a known engine configuration, a ratio of $c_{pa}$ to $c_{pc}$, useful to determine a term of Equation 4, can be modeled as follows.

$$\frac{c_{pa}}{c_{pc}} = f_2(EGR\ \%, \Phi) \quad [8]$$

Figure 4:
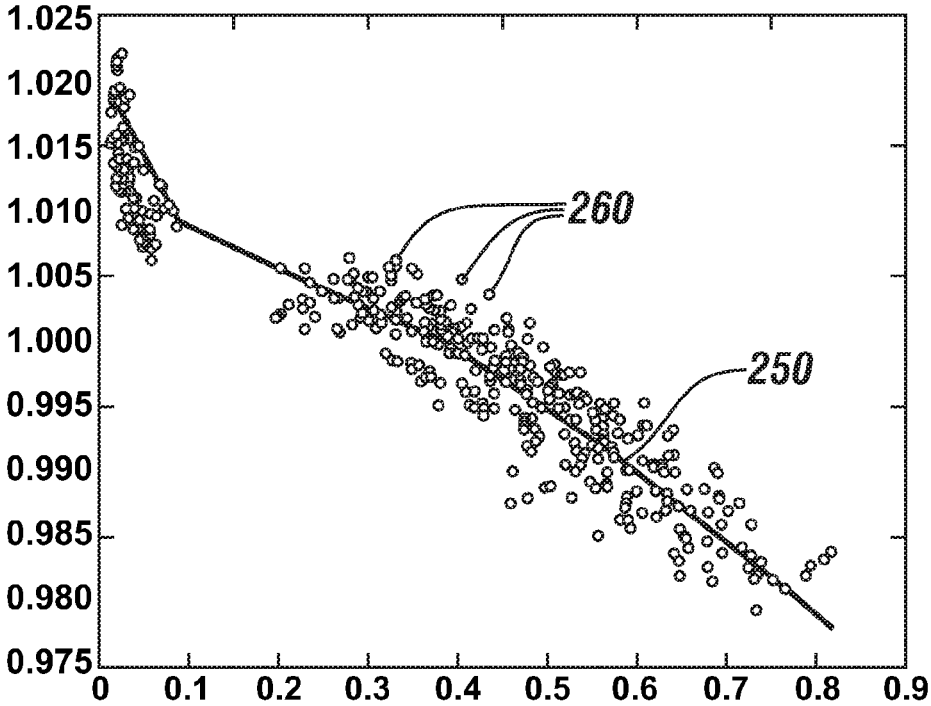
FIG. 4 illustrates values of a ratio of $c_{pa}$ to $c_{pc}$ through a range of EGR % values, in accordance with the present disclosure.

EGR % is an EGR fraction, an EGR valve position, or a measure of EGR flow (any of which may be referred to as exhaust gas recirculation) currently being directed into the intake manifold. For a particular Φ in a particular engine configuration, the ratio of $c_{pa}$ to $c_{pc}$ can be determined for a range of EGR % values. FIG. 4 illustrates values of a ratio of $c_{pa}$ to $c_{pc}$ through a range of EGR % values. The horizontal x-axis illustrates a range of EGR % values, expressed as a fraction from zero to one. The vertical y-axis illustrates a range of $c_{pa}$ to $c_{pc}$ ratio values. Points 260 illustrate data points gathered in testing of an exemplary engine configuration. Plot 250 illustrates an exemplary trend line that can be determined based upon the illustrated data points 260. In one embodiment, an engine configuration can be determined to be primarily affected by EGR %, such that only one set of data is required to determine the required ratio. In another embodiment, a plurality of data sets can be utilized to generate similar plots for different Φ values. Such a plurality of plots can be utilized in a plurality of look-up tables, in a 3 dimensional plot, or any other similar method to provide an output based upon EGR % and Φ. According to one embodiment, the ratio of $c_{pe}$ to $c_{pa}$ can be determined according to Equations 6 and 7. According to another embodiment, for a known engine configuration, a ratio of $c_{pe}$ to $c_{pa}$, useful to determine a term of Equation 4, can be modeled as follows.

$$\frac{c_{pe}}{c_{pa}} = f_3\left(\frac{T_{egr}}{T_{cac}}, \Phi\right) \quad [9]$$

Functional relationships for the specific heat ratios expressed in Eqs. 8 and 9 can each be determined based upon experimental data, calculation, modeling, or any method sufficient to comprehend engine operation and flow through an intake manifold, and the functional relationships can be stored in a lookup table, reduced to a programmed input/output response, or any other method known in the art for use in a vehicle.

Based upon accurate determinations of specific heat values through equations disclosed herein, an accurate estimation of $T_c$ can be made. According to one embodiment, the above equations can be rearranged to express the following, providing an equation to estimate $T_c$ when the EGR valve is open.

$$T_c = \frac{PD\left(\frac{N}{2}\right)\eta_v}{\left[\frac{\frac{PD\left(\frac{N}{2}\right)\eta_v c_{pc}}{R} - W_a c_{pa} T_{cac}}{c_{pe} T_{egr}} + W_a\right] R \cdot 120} \quad [10]$$

A value for $c_{pc}$ can be determined, for example, by determining a $c_{pa}/c_{pc}$ ratio according to Eq. 8, determining $c_{pa}$ according to Eq. 6, and then solving for $c_{pc}$. Use of Eq. 10 can be preferable under certain circumstances to use of Eq. 4. Eq. 4 determines $T_c$ based upon $W_c$. According to Eq. 1, $W_c$ can be determined based upon $T_c$. The dependence of $T_c$ upon $W_c$, wherein $W_c$ is dependent upon $T_c$ creates a recursive condition, wherein, for example, a value of $W_c$ from a previous iteration of $T_c$ must be used to determine a current iteration of $T_c$. Eq. 10 is determinative, wherein every term can be determined in a current iteration without dependence of any term upon $T_c$. However, Eq. 10 may not valid when EGR flow approaches zero. According to one embodiment, Eq. 10 can be utilized whether the EGR valve is opened or closed, with the assumption that Eq. 10 reduces to $T_c = T_{cac}$ when the EGR valve is closed, neglecting or ignoring as transient any small leakage from the EGR circuit or residual mixture in the intake manifold. According to another embodiment, Eq. 4 can be selected whenever an EGR valve is commanded to be closed, for example, during engine start-up, or is close to a closed position, and whenever the EGR valve is known to be open, Eq. 10 can be selected. According to one embodiment, a command to close an EGR valve can be monitored, and estimation of $T_c$ can be based upon whether the command is present or not present. According to another embodiment, Eq. 10 can be utilized when the EGR valve is open, and the following relationship can be used when the EGR valve is closed:

$$T_c = T_{cac} + \Delta T \quad [11]$$

wherein ΔT is a temperature change through the intake manifold. By monitoring whether an exhaust gas recirculation valve command indicates closure of the exhaust gas recirculation valve, the disclosed methods can be used to selectively determine $T_c$.

Figure 6:
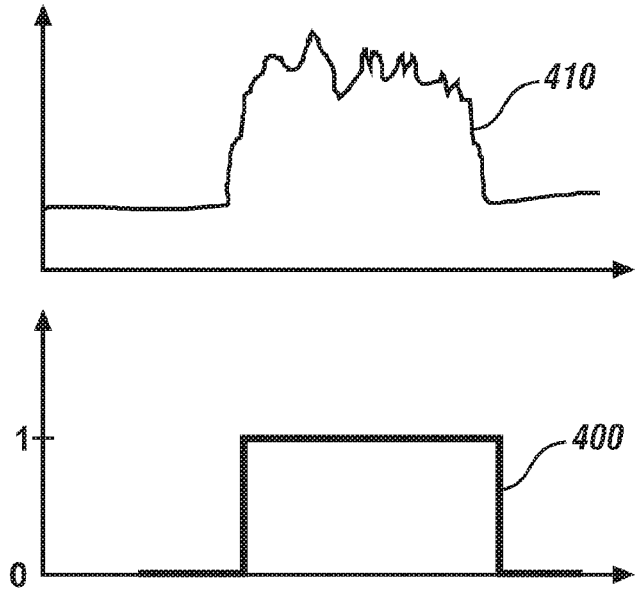
FIG. 6 illustrates exemplary results of $T_c$ estimation through a period wherein an EGR valve is open and periods wherein the EGR valve is closed, in accordance with the present disclosure.

According to one embodiment, a control module can utilize both Eqs. 10 and 11, selecting between the equations based upon whether the EGR valve is open or closed. FIG. 6 illustrates exemplary results of $T_c$ estimation through a period wherein an EGR valve is open and periods wherein the EGR valve is closed. A top graph illustrates an estimate of $T_c$ versus time, and a bottom graph illustrates an EGR valve position through the same time period as in the top graph. The horizontal x-axes of both graphs illustrate time in seconds. The vertical y-axis of the bottom graph includes a zero value for a closed EGR valve and a one value for an open EGR valve. Plot 400 illustrates an EGR valve initially in a closed state, transitioning to an open state, and then transitioning back to a closed state. The y-axis of the top graph illustrates temperature. Plot 410 illustrates a $T_c$ estimate determined according Eqs. 10 and 11 based upon whether the EGR valve is opened or closed. In both periods wherein the EGR valve is closed, $T_c$ approximates a relatively low $T_{cac}$ value. In the period wherein the EGR valve is open, temperature increases and fluctuates according to an influence of a relatively higher $T_{egr}$ value, the EGR flow mixing with the intake air flow to increase the temperature of the intake charge flow.

Figure 5:
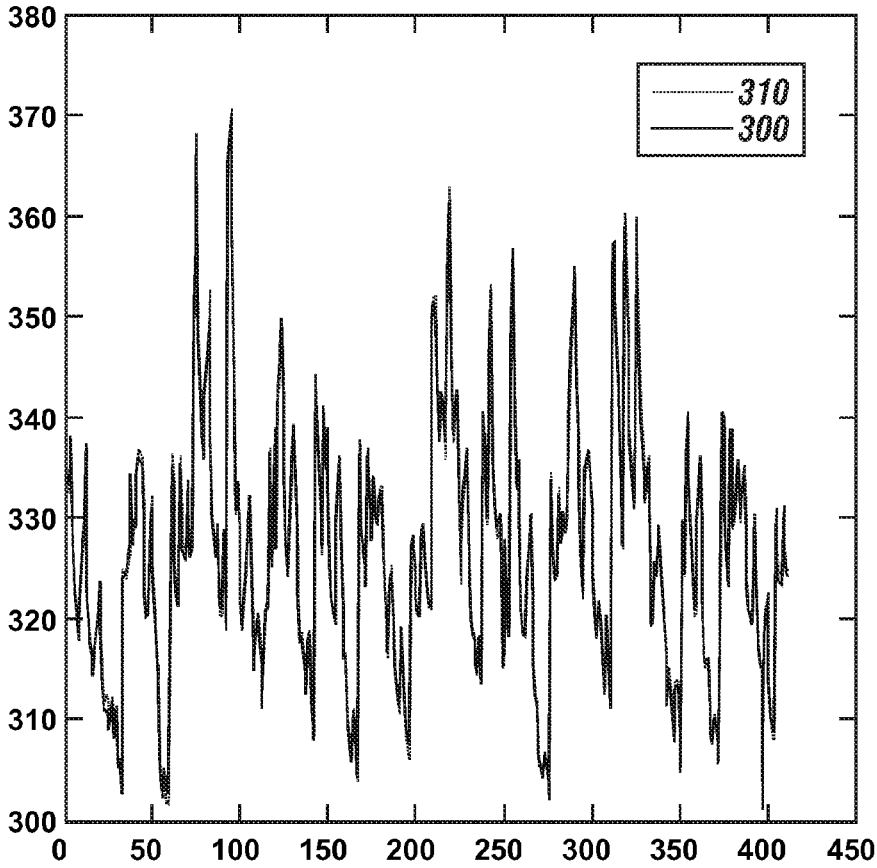
FIG. 5 illustrates exemplary results of $T_c$ estimation as compared to corresponding measured $T_c$ values in a test configuration, in accordance with the present disclosure.

FIG. 5 illustrates exemplary results of $T_c$ estimation as compared to corresponding measured $T_c$ values in a test configuration. The horizontal x-axis illustrates time through a test period. The vertical y-axis illustrates a temperature of $T_c$ in Kelvin. The test configuration is operated with a set of inputs, and a temperature sensor monitoring a temperature of the intake charge flow of the test configuration is measured through the illustrated test period. Data from the temperature sensor is illustrated as plot 300. The inputs to the test configuration are additionally processed by a module utilizing the methods disclosed herein to estimate $T_c$. The results of $T_c$ estimation are illustrated as plot 310. A comparison of plots 300 and 310 permit a conclusion that the $T_c$ estimation closely and accurate tracks the actual temperature of the intake charge flow of the test configuration.

The equations disclosed can be used to determine various terms. For example, Eq. 4 is disclosed to determine an estimate of $T_c$. If an estimate or value for $W_c$ is needed, Eq. 4 can be used in a rearranged form to determined $W_c$ from a previously determined value of $T_c$. Similarly, if a value of $c_{pc}$ is required, for example, in relation to Eq. 10, a ratio of $c_{pa}/c_{pc}$ can be determined according to Eq. 8, and a value of $c_{pa}$ from Eq. 6 can be used to determine a value for $c_{pc}$.

Figure 7:
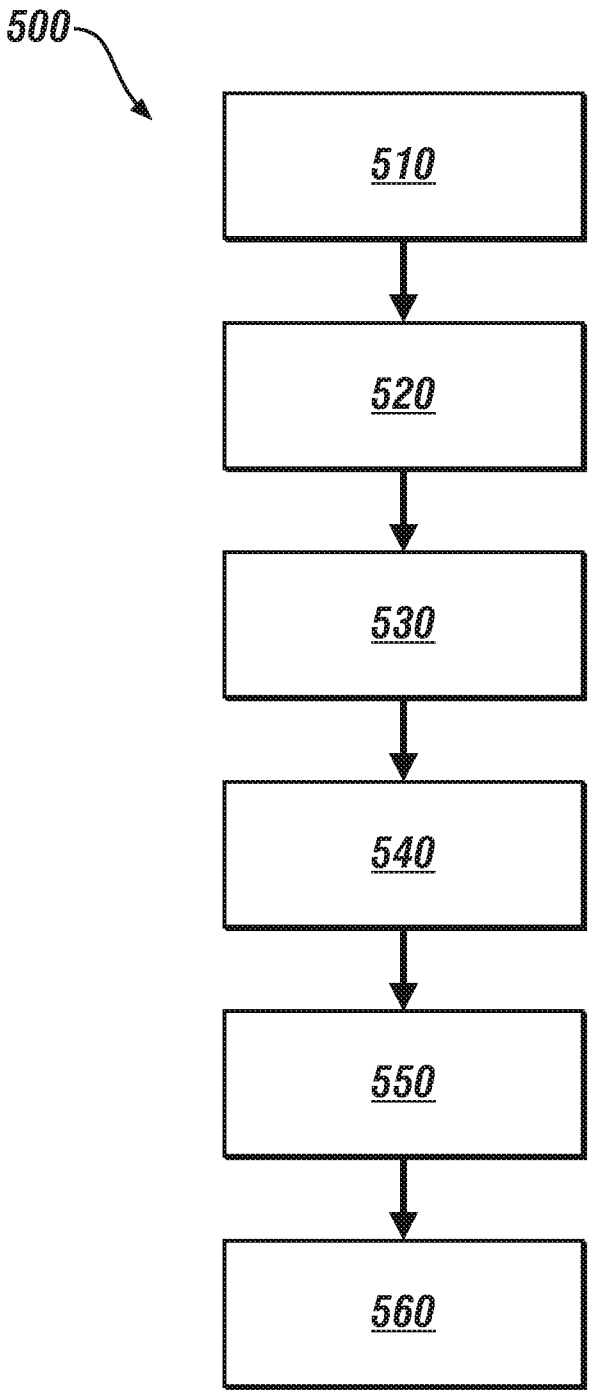
FIG. 7 illustrates an exemplary process whereby $T_c$ can be estimated and utilized to control an engine, in accordance with the present disclosure.

FIG. 7 illustrates an exemplary process whereby $T_c$ can be estimated and utilized to control an engine. Table 1 is provided as a key to FIG. 7 wherein the numerically labeled blocks and the corresponding functions are set forth as follows.

TABLE 1

| BLOCK | BLOCK CONTENTS |
|---|---|
| 510 | Monitor System Conditions Including $\Phi$, $W_a$, $W_c$, $T_{egr}$, $T_{cac}$, $P_i$, $T_{wall}$, EGR % |
| 520 | Determine $c_{pe}/c_{pa}$ Ratio |
| 530 | Determine $f_A$ |
| 540 | Determine Correction and Heat Transfer Factors |
| 550 | Determine $c_{pa}/c_{pc}$ Ratio |
| 560 | Estimate $T_c$ |

Process 500 begins in block 510. In block 510, system conditions useful to estimate $T_c$ are monitored or determined. System conditions can be monitored directly, for example, through a temperature or flow sensor. Alternatively, system conditions can be determined by monitoring data available in the vehicle according to methods known in the art. In block 520, a $c_{pe}/c_{pa}$ ratio is determined, for example, according to Eq. 9 based upon $T_{egr}$, $T_{cac}$, and $\Phi$. In block 530, $f_A$ is determined, for example, according to Eq. 5. In block 540, correction and heat transfer factors, exemplified in Eq. 2 by the term $$\frac{V}{W_c \gamma R} \cdot \frac{dP}{dt} - \dot{Q},$$

are determined, for example, based upon P, $T_{wall}$ or the temperature of a wall of the intake manifold affecting $\dot{Q}$, and $W_c$. In block 550, a $c_{pa}/c_{pc}$ ratio is determined, for example, according to Eq. 8 based upon EGR % and $\Phi$. In block 560, according to Eq. 4, $T_c$ is estimated based upon the monitored and determined terms.

Once estimated, $T_c$ can be used to control the engine. A desired $T_c$ or a $T_c$ value corresponding to intended engine operation can be monitored or determined and compared to the estimated $T_c$. If the EGR valve is closed, and the estimated $T_c$ differs from the desired $T_c$ by more than a threshold, a problem affecting the intake air flow can be determined, for example, based upon a malfunctioning charge air cooler. If the system operates normally with acceptable $T_c$ values when the EGR valve is closed but the estimated $T_c$ differs from the desired $T_c$ by more than a threshold when the EGR valve is open, then a problem affecting the EGR flow can be determined, for example, based upon a malfunctioning EGR cooler. Based upon a diagnosed malfunction, operation of the engine can be modified to compensate and an appropriate maintenance indicator can be commanded.

Estimating $T_c$ can be performed in a control module according to a number of embodiments in a single physical device or spanned across a number of physical devices. Control module, module, control, controller, control unit, processor and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), input/output circuit(s) and devices, appropriate signal conditioning and buffer circuitry, and other components to provide the described functionality. Software, firmware, programs, instructions, routines, code, algorithms and similar terms mean any controller executable instruction sets including calibrations and look-up tables. The control module has a set of control routines executed to provide the desired functions. Routines are executed, such as by a central processing unit, and are operable to monitor inputs from sensing devices and other networked control modules, and execute control and diagnostic routines to control operation of actuators. Routines may be executed at regular intervals, for example each 3.125, 6.25, 12.5, 25 and 100 milliseconds during ongoing engine and vehicle operation.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method to estimate an intake charge temperature of an intake charge flow flowing from an intake manifold of an internal combustion engine to cylinders of the engine, the intake charge flow comprising an intake air flow mixing in the intake manifold with an exhaust gas recirculation flow, the method comprising:

monitoring system conditions for the engine including monitoring an exhaust gas recirculation;

determining an effect of the mixing upon a specific heat coefficient of the intake charge flow based upon the system conditions comprising:

determining a ratio of a specific heat coefficient of the intake air flow to the specific heat coefficient of the intake charge flow based upon the exhaust gas recirculation;

estimating the intake charge temperature based upon the effect of the mixing upon the specific heat coefficient of the intake charge flow and the system conditions; and controlling the engine based upon the intake charge temperature.

2. The method of claim 1, wherein monitoring the system conditions further comprises monitoring an equivalence ratio; and wherein determining the ratio of the specific heat coefficient of the intake air flow to the specific heat coefficient of the intake charge flow is further based upon the equivalence ratio.

3. The method of claim 1, wherein monitoring the system conditions further comprises:

monitoring a ratio of an exhaust gas recirculation temperature to a charge air cooler temperature; and monitoring an equivalence ratio;

wherein determining the effect of the mixing upon the specific heat coefficient of the intake charge flow further comprises:

determining a ratio of a specific heat coefficient of the exhaust gas recirculation flow to the specific heat coefficient of the intake air flow based upon the ratio of the exhaust gas recirculation temperature to the charge air cooler temperature and the equivalence ratio.

4. The method of claim 3, wherein monitoring the system conditions further comprises:

monitoring an air fraction;

monitoring the charge air cooler temperature;

monitoring the exhaust gas recirculation temperature;

monitoring a flow rate of the intake charge flow; and monitoring a derivative of a manifold absolute pressure with respect to time;

wherein estimating the intake charge temperature utilizes the following relationship:

$$T_c = \frac{c_{pa}}{c_{pc}}\left(f_A \cdot T_{cac} + (1 - f_A) \cdot \frac{c_{pe}}{c_{pa}} T_{egr} - \frac{V}{W_c \gamma R} \cdot \frac{dP}{dt}\right);$$

wherein $T_c$ equals the intake charge temperature, $c_{pa}/c_{pc}$ equals the ratio of the specific heat coefficient of the intake air flow to the specific heat coefficient of the intake charge flow, $f_A$ equals the air fraction, $T_{cac}$ equals the charge air cooler temperature, $c_{pe}/c_{pa}$ equals the ratio of the specific heat coefficient of the exhaust gas recirculation flow to the specific heat coefficient of the intake air flow, $T_{egr}$ equals the exhaust gas recirculation temperature, V equals a volume of the intake manifold, $W_c$ equals the flow rate of the intake charge flow, γ equals a specific heat ratio, R equals a universal gas constant, and $$\frac{dP}{dt}$$

equals the derivative of the manifold absolute pressure with respect to time.

5. The method of claim 4, wherein monitoring the flow rate of the intake charge flow comprises:

determining the flow rate of the intake charge flow based upon a previously estimated intake charge temperature.

6. The method of claim 1, wherein monitoring the system conditions further comprises:

monitoring a charge air cooler temperature;

monitoring an equivalence ratio; and monitoring an exhaust gas recirculation temperature;

wherein determining the effect of the mixing upon the specific heat coefficient of the intake charge flow further comprises:

determining a specific heat coefficient of the intake air flow based upon the charge air cooler temperature;

determining a specific heat of a stoichiometric fuel air mix at constant volume based upon the exhaust gas recirculation temperature;

determining a specific heat of air at constant volume based upon the exhaust gas recirculation temperature;

determining a specific heat coefficient of the exhaust gas recirculation flow utilizing the following relationship:

$$c_{pe} = R + \Phi \cdot f_{cvstoic}(T_{egr}) + (1 - \Phi) f_{cvair}(T_{egr})$$

wherein $c_{pe}$ equals the specific heat coefficient of the exhaust gas recirculation flow, R equals a universal gas constant, Φ equals the equivalence ratio, $T_{egr}$ equals the exhaust gas recirculation temperature, $f_{cvstoic}(T_{egr})$ equals the specific heat of a stoichiometric fuel air mix at constant volume determined based upon the exhaust gas recirculation temperature, and $f_{cvair}(T_{egr})$ equals the specific heat of air at constant volume determined based upon the exhaust gas recirculation temperature; and determining a ratio of the specific heat coefficient of the exhaust gas recirculation flow to the specific heat coefficient of the intake air flow.

7. The method of claim 6, wherein monitoring the system conditions further comprises:

monitoring an air fraction;

monitoring a flow rate of the intake charge flow; and monitoring a derivative of a manifold absolute pressure with respect to time;

wherein estimating the intake charge temperature utilizes the following relationship:

$$T_c = \frac{c_{pa}}{c_{pc}}\left(f_A \cdot T_{cac} + (1 - f_A) \cdot \frac{c_{pe}}{c_{pa}} T_{egr} - \frac{V}{W_c \gamma R} \cdot \frac{dP}{dt}\right);$$

wherein $T_c$ equals the intake charge temperature, $c_{pa}/c_{pc}$ equals the ratio of the specific heat coefficient of the intake air flow to the specific heat coefficient of the intake charge flow, $f_A$ equals the air fraction, $T_{cac}$ equals the charge air cooler temperature, $c_{pe}/c_{pa}$ equals the ratio of the specific heat coefficient of the exhaust gas recirculation flow to the specific heat coefficient of the intake air flow, $T_{egr}$ equals the exhaust gas recirculation temperature, V equals a volume of the intake manifold, $W_c$ equals the flow rate of the intake charge flow, γ equals a specific heat ratio, R equals a universal gas constant, and $$\frac{dP}{dt}$$

equals the derivative of the manifold absolute pressure with respect to time.

8. The method of claim 1, wherein monitoring the system conditions further comprises:

monitoring an exhaust gas recirculation valve command;

monitoring a charge air cooler temperature;

monitoring an exhaust gas recirculation temperature;

monitoring a flow rate of the intake air flow;

monitoring a manifold absolute pressure; and monitoring an engine speed;

wherein determining the effect of the mixing upon the specific heat coefficient of the intake charge flow further comprises:

determining a specific heat coefficient of the intake air flow based upon the system conditions;

determining a specific heat coefficient of the exhaust gas recirculation flow based upon the system conditions; and determining the specific heat coefficient of the intake charge flow based upon the specific heat coefficient of the intake air flow and the ratio of the specific heat coefficient of the intake air flow to the specific heat coefficient of the intake charge flow; and wherein, when the exhaust gas recirculation valve command does not indicate closure of the exhaust gas recirculation valve, estimating the intake charge temperature utilizes the following relationship:

$$T_c = \frac{PD\left(\frac{N}{2}\right)\eta_v}{\left[\frac{\frac{PD\left(\frac{N}{2}\right)\eta_v c_{pc}}{R} - W_a c_{pa} T_{cac}}{c_{pe} T_{egr}} + W_a\right] R \cdot 120};$$

wherein $T_c$ equals the intake charge temperature,

P equals the manifold absolute pressure,

D equals a cylinder displacement volume,

N equals an engine speed, $\eta_v$ equals a volumetric efficiency of the engine, $c_{pc}$ equals the specific heat coefficient of the intake charge flow, $W_a$ equals a flow rate of the intake air flow, $c_{pa}$ equals the specific heat coefficient of the intake air flow, $T_{cac}$ equals the charge air cooler temperature, $c_{pe}$ equals the specific heat coefficient of the exhaust gas recirculation flow, $T_{egr}$ equals the exhaust gas recirculation temperature, and R equals a universal gas constant.

9. The method of claim 8 wherein, when the exhaust gas recirculation valve command indicates closure of the exhaust gas recirculation valve, estimating the intake charge temperature utilizes the following relationship:

$$T_c = T_{cac} + \Delta T;$$

wherein $\Delta T$ is a temperature change within the intake manifold.

10. The method of claim 8, wherein monitoring the system conditions further comprises:

monitoring an air fraction;

monitoring an exhaust gas recirculation temperature;

monitoring a flow rate of the intake charge flow;

monitoring a manifold absolute pressure; and monitoring a derivative of the manifold absolute pressure with respect to time wherein determining the effect of the mixing upon a specific heat coefficient of the intake charge flow further comprises:

determining a ratio of the specific heat coefficient of the exhaust gas recirculation flow to the specific heat coefficient of the intake air flow;

wherein, when the exhaust gas recirculation valve command indicates closure of the exhaust gas recirculation valve, estimating the intake charge temperature utilizes the following relationship:

$$T_c = \frac{c_{pa}}{c_{pc}}\left(f_A \cdot T_{cac} + (1 - f_A) \cdot \frac{c_{pe}}{c_{pa}} T_{egr} - \frac{V}{W_c \gamma R} \cdot \frac{dP}{dt}\right);$$

wherein $T_c$ equals the intake charge temperature, $c_{pa}/c_{pc}$ equals the ratio of the specific heat coefficient of the intake air flow to the specific heat coefficient of the intake charge flow, $f_A$ equals the air fraction, $T_{cac}$ equals the charge air cooler temperature, $c_{pe}/c_{pa}$ equals the ratio of the specific heat coefficient of the exhaust gas recirculation flow to the specific heat coefficient of the intake air flow, $T_{egr}$ equals the exhaust gas recirculation temperature, V equals a volume of the intake manifold, $W_c$ equals the flow rate of the intake charge flow, $\gamma$ equals a specific heat ratio, R equals a universal gas constant, and $\frac{dP}{dt}$ equals the derivative of the manifold absolute pressure with respect to time.

11. Method to estimate an intake charge temperature of an intake charge flow flowing from an intake manifold of an internal combustion engine to cylinders of the engine, the intake charge flow comprising an intake air flow mixing in the intake manifold with an exhaust gas recirculation flow, the method comprising:

monitoring system conditions for the engine;

determining a ratio of a specific heat coefficient of the intake air flow to a specific heat coefficient of the intake charge flow based upon the system conditions;

determining a ratio of a specific heat coefficient of the exhaust gas recirculation flow to the specific heat coefficient of the intake air flow based upon the system conditions;

estimating the intake charge temperature based upon the ratio of the specific heat coefficient of the intake air flow to the specific heat coefficient of the intake charge flow, the ratio of the specific heat coefficient of the exhaust gas recirculation flow to the specific heat coefficient of the intake air flow, and the system conditions; and controlling the engine based upon the estimated intake charge temperature.

12. System to estimate an intake charge temperature in an intake manifold of an internal combustion engine comprising a charging system providing an intake air flow and an exhaust gas recirculation circuit providing an exhaust gas recirculation flow, the system comprising:

the intake manifold mixing the intake air flow and exhaust gas recirculation flow to provide an intake charge flow to cylinders of the engine; and a control module:

monitoring system conditions for the engine including monitoring an exhaust gas recirculation;

determining an effect of the mixing upon a specific heat coefficient of the intake charge flow based upon the system conditions comprising:

determining a ratio of a specific heat coefficient of the intake air flow to the specific heat coefficient of the intake charge flow based upon the exhaust gas recirculation;

estimating the intake charge temperature based upon the effect of the mixing upon the specific heat coefficient of the intake charge flow and the system conditions; and controlling the engine based upon the estimated intake charge temperature.

13. The system of claim 12, wherein the control module further monitors an exhaust gas recirculation valve command; and wherein estimating the intake charge temperature is based upon the exhaust gas recirculation valve command.

14. The system of claim 12:

wherein monitoring system conditions for the engine further comprises:

monitoring a ratio of an exhaust gas recirculation temperature to a charge air cooler temperature; and monitoring an equivalence ratio;

wherein determining a ratio of a specific heat coefficient of the intake air flow to the specific heat coefficient of the intake charge flow comprises:

referencing a look-up table providing a calibrated ratio of a specific heat coefficient of the intake air flow to the specific heat coefficient of the intake charge flow;

wherein determining the effect of the mixing upon the specific heat coefficient of the intake charge flow further comprises:

referencing a look-up table providing a calibrated ratio of a specific heat coefficient of the exhaust gas recirculation flow to the specific heat coefficient of the intake air flow; and wherein estimating the intake charge temperature comprises estimating the intake charge temperature based upon the calibrated ratio of the specific heat coefficient of the intake air flow to the specific heat coefficient of the intake charge flow and the calibrated ratio of the specific heat coefficient of the exhaust gas recirculation flow to the specific heat coefficient of the intake air flow.

* * * * *